US008079304B2

(12) United States Patent
Homann et al.

(10) Patent No.: US 8,079,304 B2
(45) Date of Patent: Dec. 20, 2011

(54) METHOD AND DEVICE FOR PRESSING

(75) Inventors: Thorsten Homann, Hamburg (DE); Jens Schulz, Hamburg (DE); Roman Zmuszinski, Hamburg (DE)

(73) Assignee: Harburg-Freudenberger Maschinenbau GmbH, Hamburg (DE)

( * ) Notice: Subject to any disclaimer, the term of this patent is extended or adjusted under 35 U.S.C. 154(b) by 148 days.

(21) Appl. No.: 12/290,425

(22) Filed: Oct. 29, 2008

(65) Prior Publication Data

US 2009/0126583 A1 May 21, 2009

Related U.S. Application Data

(63) Continuation-in-part of application No. 11/412,708, filed on Apr. 26, 2006, now abandoned.

(30) Foreign Application Priority Data

Apr. 26, 2006 (DE) ..... 10 2005 019 294

(51) Int. Cl.
*B30B 9/14* (2006.01)

(52) U.S. Cl. ..... 100/37; 100/74; 100/117

(58) Field of Classification Search ..... 100/37, 100/70 R, 74, 75, 117, 145, 146, 337, 339; 554/11, 12
See application file for complete search history.

(56) References Cited

U.S. PATENT DOCUMENTS 4,024,168 A * 5/1977 Homann et al. ..... 554/22
5,939,571 A * 8/1999 Foidl ..... 554/12
2002/0174780 A1* 11/2002 Clifford ..... 100/37

FOREIGN PATENT DOCUMENTS

WO WO 87/01381 A1 * 3/1987

* cited by examiner

*Primary Examiner* — Jimmy T Nguyen
(74) *Attorney, Agent, or Firm* — Lucas & Mercanti, LLP; Klaus P. Stoffel

(57) ABSTRACT

A method and a device for pressing a liquid extract from a material to be pressed include a screw press which conveys the material to be pressed along a pressing route and applies pressure to it. In addition, at least one extracting agent is added to the material to be pressed and is removed, together with the extract, from the pressed material. The extracting agent is supplied to the material to be pressed in an amount that is no more than twice the weight of the extract contained in the material to be pressed. At least a portion of the extracting agent dissolves in the extract.

15 Claims, 3 Drawing Sheets

1
2
3
4
5
6
7
8
9
10
11
12
13
14
15
16
17
18
19
20
21
22
23
24
25
26
27
28
$CO_2$
Q
Q
$CO_2$
Oil + $CO_2$
Oil

METHOD AND DEVICE FOR PRESSING

The present application is a continuation-in-part of U.S. patent application Ser. No. 11/412,708 filed Apr. 26, 2006, now abandoned, the entire contents of which are incorporated herein by reference.

BACKGROUND OF THE INVENTION

1. Field of the Invention

The present invention relates to a method for pressing a liquid extract from material to be pressed, in which a screw press conveys the material to be pressed along a pressing route and applies pressure to it, and in which the material to be pressed is treated with at least one extracting agent, which is removed from the pressed material together with the extract.

In addition, the invention relates to a device for pressing a liquid extract from a material, which device is designed as a screw press which has a worm that is movably guided in a cylinder wall and which is connected to at least one feeding device for an extracting agent and to at least one collecting device for the extract.

2. Description of the Related Art

Methods and devices of these types are used, for example, to press oil from oilseeds. It is already well known that the pressing process can be assisted by mixing the material to be pressed with a large excess of supercritical carbon dioxide and dissolving the oily extract in the supercritical carbon dioxide at very high pressures. In this connection, the supercritical state describes a physical state of matter in transition from the gaseous to the liquid phase of the carbon dioxide. After being removed from the press, the extract dissolved in the supercritical carbon dioxide is recovered in pure form by vaporization of the carbon dioxide. The vaporized carbon dioxide is either released into the atmosphere or recompressed and reused.

The production and handling of the supercritical carbon dioxide and the necessary equipment expense for handling the considerable amounts of this extracting agent result in expenses that are too high for many applications.

SUMMARY OF THE INVENTION

Therefore, it is the primary object of the present invention to improve a method of the aforementioned type in such a way that a high level of process effectiveness is achieved at an acceptable level of expense.

In accordance with the invention, this object is met by supplying the extracting agent to the material to be pressed in amounts that are at most twice the weight of the extract contained in the material to be pressed.

A further objective of the present invention is to design a device of the aforementioned type in such a way that a high degree of extraction can be achieved with reduced equipment expense.

In accordance with the invention, this further object is met by connecting the feeding device for the extracting agent with a metering device that limits the amount of extracting agent supplied to a maximum of twice the weight of extract contained in the material to be pressed.

In accordance with the invention, it was discovered that it is not necessary to dissolve the extract in the extracting agent and to remove it from the pressed material in this dissolved state, but rather that excellent extraction rates can be achieved if the extract is merely diluted with the extracting agent, or if the extracting agent is dissolved in the extract. The amounts of extracting agents that are required in prior-art processes, which generally far exceed ten times the weight of the extract to be recovered, can be greatly reduced in this way. The costs and work involved in the production of the extracting agent and the subsequent separation of the extracting agent from the extract can likewise be greatly reduced in this way.

A reduced amount of extracting agent can be achieved if the weight of the extracting agent is no more than the weight of the extract contained in the material to be pressed.

As a rule, it is sufficient to supply the extracting agent to the material to be pressed in an amount that is no more than 50% of the weight of the extract contained in the material to be pressed.

The extracting agent can be predominantly dissolved in the extract with a slight excess of extracting agent to provide gas pressure if the extracting agent is supplied to the material to be pressed in an amount that is no more than 25-35% of the weight of the extract contained in the material to be pressed.

Especially for extracting oils from vegetable materials by pressing, it has been found to be advantageous to use carbon dioxide as the extracting agent supplied to the material to be pressed.

A typical range of pressures at which the extracting agent is supplied to the material to be pressed is about 100-200 bars.

In particular, the invention proposes that the extracting agent be supplied to the material to be pressed at a pressure of about 150 bars.

Typical operating conditions for pressing out the extract after the extracting agent has been supplied involve temperatures of about 35-60° C.

Due to the frictional energy produced by the mechanical pressing, the extract is generally pressed out in the temperature range of 40-45° C. that becomes established after the extracting agent has been supplied.

Typical mechanical pressing power ensures that mechanical pressure in the range of 200-300 bars is produced.

In particular, it is proposed that mechanical pressing power on the order of 250 bars is produced.

The yield of extract can be increased by subjecting the material to be pressed to several successive pressing steps.

In particular, it has been found to be advantageous for the material to be subjected to mechanical prepressing in a first pressing step.

It is also advantageous for extracting agent to be added to the material to be pressed after this prepressing step and for the extracting agent to be at least partially dissolved in the extract.

A typical process is carried out by performing a pressing operation after the extracting agent has been dissolved in the extract.

The yield of extract can be further increased if the extract to which the extracting agent has been added is subjected at least twice to a pressure increase and a pressure decrease.

The achievement of a simple mechanical basic design is assisted by dividing the interior of the cylinder into its separate zones by at least two throttles arranged on the press worm.

Increased solubility of the extracting agent in the extract is assisted by providing the feeding device for the extracting agent with a heater.

In accordance with a typical embodiment, it is provided that the feeding device for the extracting agent can withstand pressures of up to 250 bars.

In a typical design variant, at least one connection for supplying the extracting agent is installed in the vicinity of the cylinder wall.

Alternatively or additionally, it is also possible for at least certain regions of the press worm to be hollow and for these hollow regions to be provided with outlets for supplying the extracting agent.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
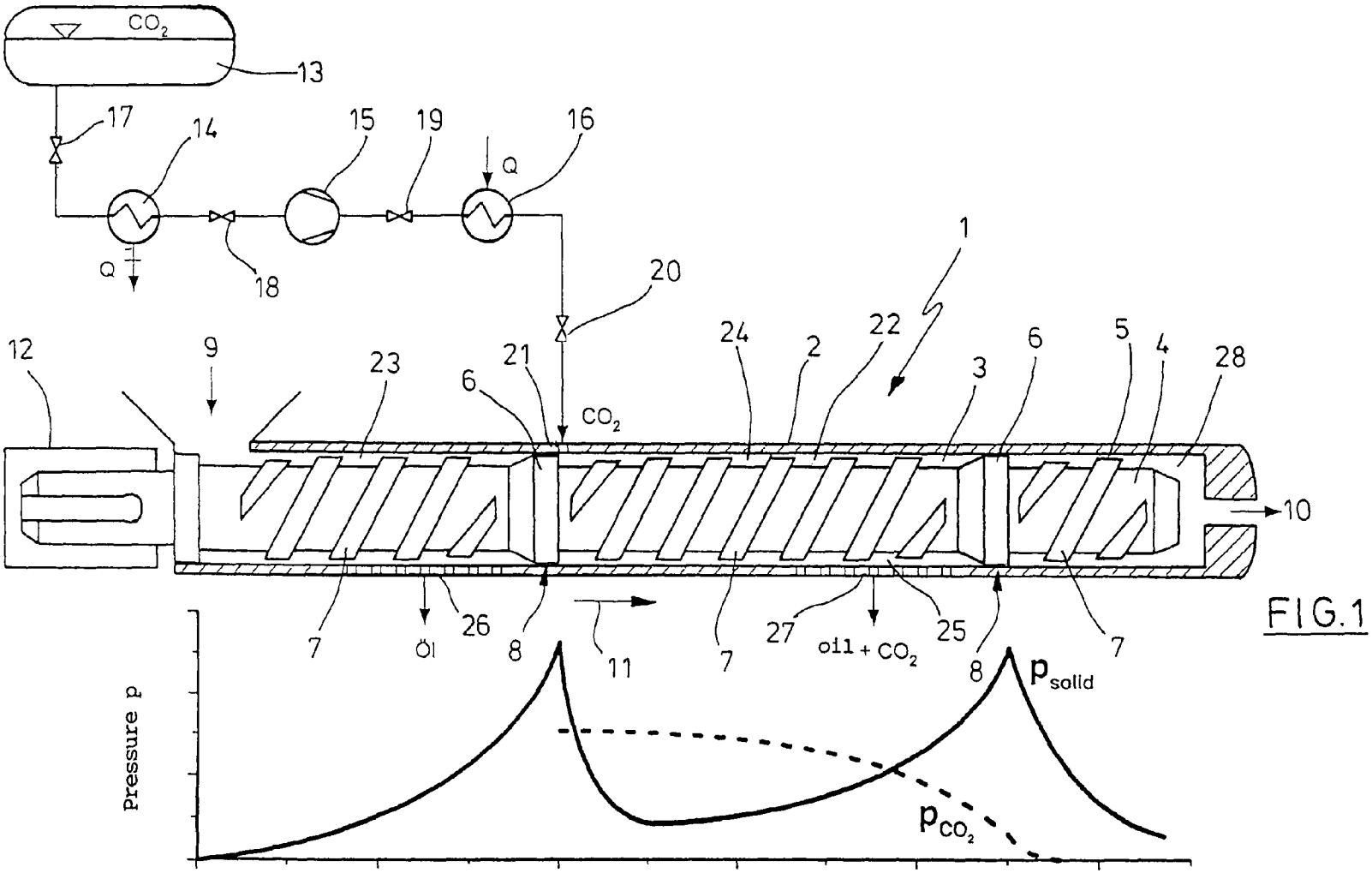
FIG. 1 is a schematic view of a longitudinal section through a screw press with extracting agent feed and extract discharge.

FIG. 1 shows a screw press 1, which is provided with a cylinder wall 2 and with a press worm 3 that is movably guided within the cylinder wall 2. A worm helix, which is divided into individual helix segments 7 by throttles 6 arranged on a worm body 4, extends along the essentially cylindrical worm body 4. The throttles 6 are designed as thickened regions of the worm body and, together with the cylinder wall 2, bound relatively narrowly dimensioned gaps 8.

The cylinder wall 2 is provided with a material feed inlet 9 and a solids discharge outlet 10. The material is conveyed in a direction of conveyance 11 from the material feed inlet 9 to the solids discharge outlet 10. The material feed inlet 9 is typically located near an end of the cylinder wall 2 in the vicinity of a worm drive 12. The solids discharge outlet 10 is typically located near the opposite end of the cylinder wall 2 from the worm drive 12.

In the specific embodiment illustrated in FIG. 1, the extracting agent is fed to the screw press 1 from a storage tank 13. Carbon dioxide in the liquid or gaseous state is typically used as the extracting agent. The extracting agent is supplied to the screw press 1 via a cooler 14, a high-pressure pump 15 and a heater 16. The individual functional components are typically separated from each other by valves 17, 18, 19, 20. In the specific embodiment illustrated in FIG. 1, this results in sequential connection of the storage tank 13, the valve 17, the cooler 14, the valve 18, the high-pressure pump 15, the valve (19), the heater 16, the valve 20, and a connection (21) in the area of the cylinder wall 2.

Basically, it can be said that the extracting agent is supplied by a feeding device that includes the storage tank 13. The storage tank holds the extracting agent is composed of a material or substance that will reduce the viscosity of the extract. The feeding device has at least one valve that is controllable so that the amount of extracting agent supplied is also controlled so that the weight of the extracting agent is no more than the weight of the extract contained in the material to be processed and the extracting agent is dissolved in the extract, whereby the extracting agent reduces the viscosity of the extract In the specific embodiment illustrated in FIG. 1, an interior space 22 of the cylinder is divided into a prepressing zone 23, an extruder zone 24, and a pressing zone 25. The prepressing zone 23 is provided with a primary discharge outlet 26 for mechanically expressed extract. The extruder zone 24 is provided with one or more secondary discharge outlets 27 for extracting agent mixed with the extract or for extracting agent dissolved in the extract. The extruder zone 24 is followed by a discharge zone (28) located adjacent to the solids discharge outlet 10. The connection 21 for feeding the extracting agent is typically located directly after (with respect to the direction of conveyance 11) a first throttle 6, which separates the prepressing zone 23 from the extruder zone 24.

When carbon dioxide is used as the extracting agent, the storage tank 12 is typically designed for pressures up to 65 bars at an extracting agent temperature of 22° C. The cooler 14 is likewise designed to withstand pressures up to about 65 bars. It cools the extracting agent to a temperature of about 15-18° C. The high-pressure pump 15 raises the pressure to 150-300 bars, which causes the temperature to rise to 32-50° C. The temperature is raised further to about 60-100° C. by the heater 16.

The material to be pressed is fed into the screw press through the material feed inlet 9, usually at ambient temperature. In the prepressing zone 13, a mechanical pressure buildup occurs to a pressure in the range of 150-300 bars, and the temperature rises to about 60° C. A pressure in the range of 150-300 bars is maintained in the extruder zone 24, and the temperature in this zone is typically in the range of 60-100° C. The same physical parameters are also found in the pressing zone 25.

Figure 2:
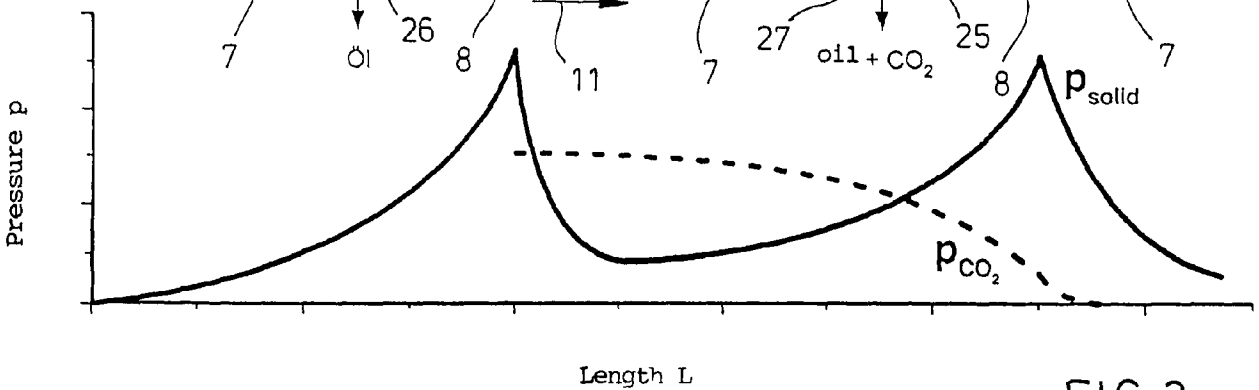
FIG. 2 is a graph that illustrates a pressure curve in the press of FIG. 1.

FIG. 2 shows a typical pressure curve along the direction of conveyance 11 during the operation of the screw press 1. Both the pressure on the solids and the pressure of the extracting agent are plotted.

Figure 3:
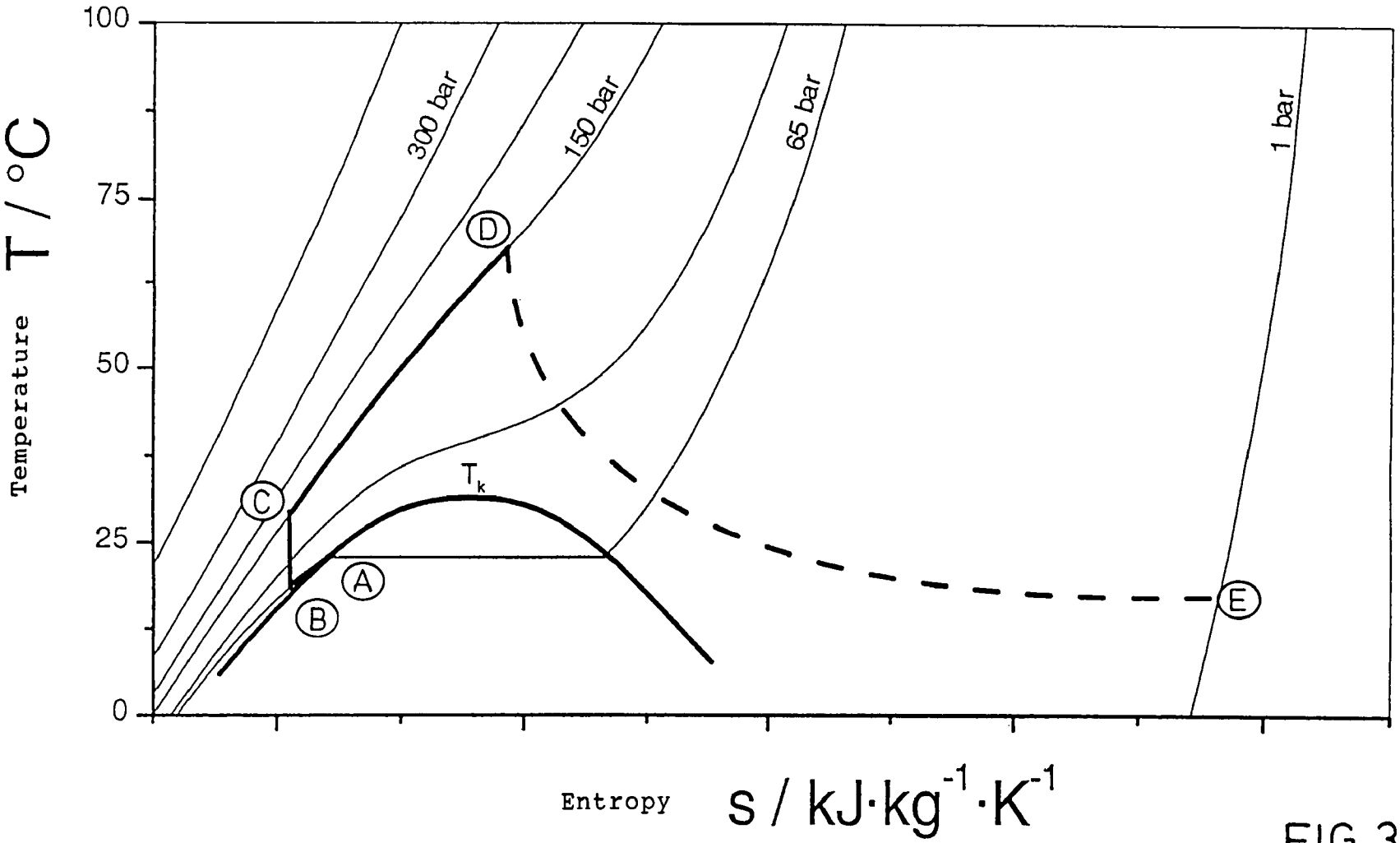
FIG. 3 is a graph that illustrates the relation of temperature and entropy of the carbon dioxide.

To illustrate the physical properties of the carbon dioxide used as the extracting agent, FIG. 3 shows a graph of the temperature as a function of the entropy, wherein the individual curves are assigned to certain plotted pressures. The region between A and B corresponds to isobaric cooling, the region between B and C to isoentropic compression, the region between C and D to isobaric heating, and the region between D and E to nonadiabatic expansion or degassing.

In a comparison of FIG. 3 with the drawing in FIG. 1, the region A-B can be associated with the cooling that occurs in the cooler 14, and the region B-C corresponds to the compression by the high-pressure pump 15. The curve C-D corresponds to the heating that occurs in the heater 16, and the curve D-E corresponds to the process sequence between the connection 21 and the secondary discharge outlet 27.

The process sequence is explained in greater detail below on the basis of the example of the use of carbon dioxide as the extracting agent with reference to the specific embodiment illustrated in FIG. 1. Mechanical digestion of the material to be pressed is first carried out in the prepressing zone 23. This material may be, for example, oilseed from which the oil is to be extracted. The oil extracted in this preliminary extraction is discharged through the primary discharge outlet 26. The primary discharge outlet 26 can be formed, for example, by a straining basket that is open towards the outside. The prepressing zone 23 is bounded in the direction of conveyance 11 by the throttle 6, which has a throttle geometry such that the solids on which a preliminary oil extraction has been carried out can be compressed essentially gastight.

After the first throttle 6 in the direction of conveyance, there is an injection zone for the extracting agent, in this case, carbon dioxide. The connection 21 is provided for this purpose. The extruder zone 24 provides an extruder region in a closed strainer. In the region of the extracting agent feed after the throttle 6, the solid material is first loosened again, and the extracting agent dissolves in the extract or mixes with it. In the application example of an extraction of seedoil, the dissolution of the carbon dioxide greatly reduces the viscosity and thus results in definite liquefaction. When the dissolving capacity of the extract for the extracting agent is reached, the additionally added carbon dioxide provides additional gas pressure on top of the solids pressure.

In the specific embodiment illustrated in FIG. 1, the extruder zone 24 is formed as a uniform region between two throttles 6. In principle, it is possible to divide the extruder zone 24 into individual extruder regions by additional throttles, so that alternating pressure increases and pressure reductions can be carried out.

In the region of the pressing zone 25, the free-flowing oil loaded with carbon dioxide can be discharged from the cylinder interior 22. In principle, it is possible to design the pressing zone 25 as an open straining cage, so that the oil is discharged both by the mechanical pressing pressure and, in addition, by the superposed gas pressure of the fraction of carbon dioxide that is not dissolved in the oil. Additional discharge of the oil is effected by the radial pressure drop in the straining basket due to the release of carbon dioxide from the oil. The pressing zone 25 is preferably positioned in an area before the last throttle 6 in the direction of conveyance 11.

For operation of the system illustrated in FIG. 1, it has been found to be advantageous to store liquid carbon dioxide in the storage tank 13 and to feed it to the high-pressure pump 15 at ambient temperature. The high-pressure pump 15 is preferably designed as a piston pump. The main purpose of the cooler 14 is to prevent the formation of vapor bubbles on the intake side of the high-pressure pump 15. The cooler 14 can be realized as a heat exchanger cooled with cold water or brine.

To allow the carbon dioxide to be fed to the cylinder interior 22 in a supercritical state, the temperature of the compressed carbon dioxide is increased by the heater 16.

The high pressure of the carbon dioxide when it is fed into the cylinder interior 22, together with the high solids pressure that prevails, means that a high level of solubility of the carbon dioxide in the extract to be recovered is achieved. In general, with increasing pressure, more extracting agent can be dissolved in the extract to be recovered. In particular, feeding the carbon dioxide at high pressure directly after the throttle 6 already makes it possible to achieve a high resultant total pressure in this region. The solids pressure is initially low after the throttle 6 and then increases, as shown by the curve in FIG. 2, along the conveyance path to the next throttle 6. The pressure of the solids, which is produced by the rotary motion of the extruder screw 3, and the pressure of the carbon dioxide are basically superposed (see pressure curves in FIG. 2).

Due to the interaction of the extract and the extracting agent dissolved in the extract, it is possible to arrange both the prepressing zone 23 and the pressing zone 25 outside of the cylinder wall 2 under normal ambient conditions, and a casing that can withstand high pressure can be dispensed with. Both the extract discharged from the outlets 26, 27 and the oil-free solids discharged from the solids discharge outlet 10 are largely degassed and are at a pressure level corresponding to ambient pressure. This helps to realize an extremely simple operation for the user.

The system illustrated in FIG. 1 can typically be dimensioned in such a way that material can be fed to the screw press 1 at rates of about 3,000 to 6,000 kg/hour. In the case of the extraction of oil from oilseed, oil can thus be extracted in amounts of 600 to 1,200 kg/hour. Of these amounts of oil, 200-400 kg/hour are typically mechanically extracted in the prepressing zone 23, and 400-800 kg/hour are discharged in the extruder zone 24. 80-300 kg/hour of carbon dioxide are typically supplied to recover these amounts of oil. Of these amounts of carbon dioxide, an amount of up to 60 kg/hour remains undissolved in the pressed material and serves to provide the necessary gas pressure.

In accordance with another embodiment for smaller throughputs, precrushed soybeans with an oil content of 18-20% and a water content of about 10% are fed to the screw press as the material to be pressed. The feed temperature of the material is 20° C., and the throughput is 100 kg/hour. The liquid carbon dioxide is fed to the screw press 1 at a rate of 15 kg/hour and a temperature of 20° C. A temperature of 35-45° C. becomes established along the conveyance path in the extruder zone 24. The expressed oil has a temperature of about 70° C. immediately after discharge from the secondary discharge outlet 27. Due to the combination of the mechanical pressing and the dissolving of the extracting agent in the extract and the resulting reduction of the viscosity, the solids discharged from the solids discharge outlet 10 have a residual fat content of a maximum of 3 wt. %.

Figure 4:
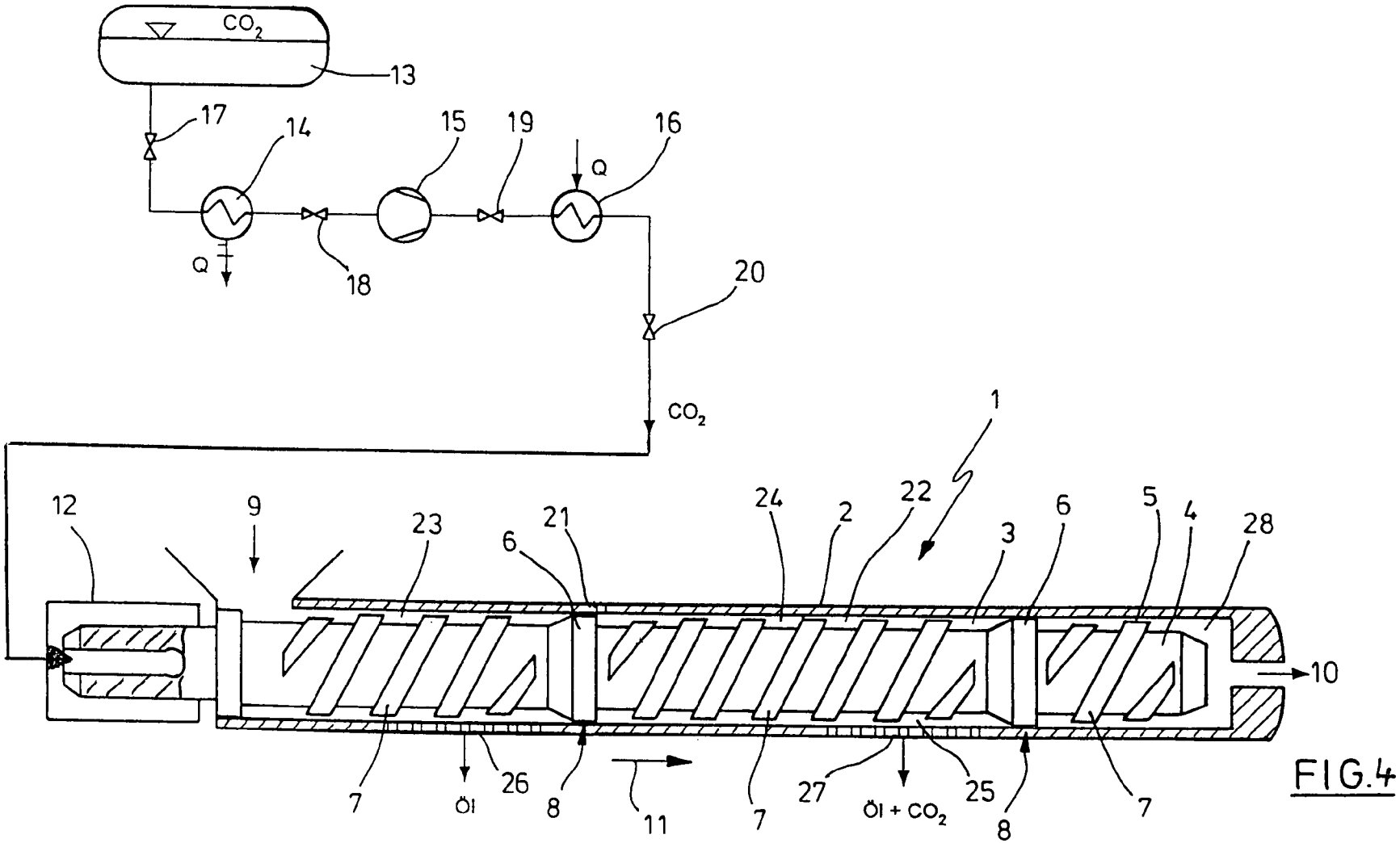
FIG. 4 is a schematic view as in FIG. 1 of another embodiment.

FIG. 4 schematically shows an embodiment of the screw press 1 in which the extraction agent is supplied to hollow regions of the press worm 3. It is understood that FIG. 4 is only representative of supplying the extraction agent to the hollow regions in general and does not serve to limit the invention to only supplying the extracting agent at the location shown in the drawing.

While specific embodiments of the invention have been shown and described in detail to illustrate the inventive principles, it will be understood that the invention may be embodied otherwise without departing from such principles.

We claim:

1. A method for pressing a liquid extract from material to be pressed, comprising conveying the material to be pressed with a screw press along a pressing route and applying pressure to the material and treating the material to be pressed is treated with at least one extracting agent, removing the extracting agent from the pressed material together with the extract, further comprising supplying the extracting agent to the material to be pressed in amounts that are at most twice a weight of the extract contained in the material to be pressed, wherein the weight of the extracting agent is no more than the weight of the extract contained in the material to be processed, the extracting agent being dissolved in the extract, and the extracting agent reducing the viscosity of the extract.

2. The method in accordance with claim 1, comprising supplying the extracting agent to the material to be pressed in an amount that is no more than 50% of the weight of the extract contained in the material to be pressed.

3. The method in accordance with claim 1, comprising supplying the extracting agent to the material to be pressed in an amount that is no more than 25-35% of the weight of the extract contained in the material to be pressed.

4. The method in accordance with claim 1, comprising supplying carbon dioxide as the extracting agent to the material to be pressed.

5. The method in accordance with claim 1, comprising supplying the extracting agent to the material to be pressed at a pressure of about 100-200 bars.

6. The method in accordance with claim 1, comprising supplying the extracting agent to the material to be pressed at a pressure of about 150 bars.

7. The method in accordance with claim 1, comprising, after the extracting agent has been supplied, expressing the extract at a temperature of about 35-60° C.

8. The method in accordance with claim 1, comprising, after the extracting agent has been supplied, expressing the extract at a temperature of about 40-45° C.

9. The method in accordance with claim 1, comprising producing mechanical pressing power in the range of 200-300 bars.

10. The method in accordance with claim 1, comprising producing mechanical pressing power on the order of 250 bars.

11. The method in accordance with claim 1, comprising subjecting the material to be pressed to several successive pressing steps.

12. The method in accordance with claim 1, comprising mechanically prepressing the material to be pressed in a first pressing step.

13. The method in accordance with claim 1, comprising adding extracting agent to the material to be pressed after the prepressing step, and at least partially dissolving the extracting agent in the extract.

14. The method in accordance with claim 1, comprising carrying out a pressing operation after the extracting agent has been dissolved in the extract.

15. The method in accordance with claim 1, comprising subjecting the extract to which the extracting agent has been added at least twice to a pressure increase and a pressure decrease.

* * * * *